US005454554A

United States Patent [19]

Boughton et al.

[11] Patent Number: 5,454,554

[45] Date of Patent: Oct. 3, 1995

[54] PIVOTING FEEDER ASSEMBLY FOR JAM ACCESS

[75] Inventors: Richard Boughton, Newtown; Joseph Briggs, deceased, late of Bethel, by Elaine Briggs, executrix; Carlos L. DeFiguerido; Joan Doutney, both of Sandy Hook; Sandra Graveson, Waterbury; Joseph H. Marzullo, Brookfield; Walter Wolog, Orange, all of Conn.

[73] Assignee: Pitney Bowes Inc., Stamford, Conn.

[21] Appl. No.: 113,543

[22] Filed: Aug. 27, 1993

[51] Int. Cl.[6] ..... B65H 5/26

[52] U.S. Cl. ..... 271/9.01; 271/109; 271/145

[58] Field of Search ..... 271/9, 109, 117, 271/145, 162, 292

[56] References Cited

U.S. PATENT DOCUMENTS

| | | | |
|---|---|---|---|
| 4,728,095 | 3/1988 | Irvine et al. | 271/9 |
| 4,942,535 | 7/1990 | Francisco | 364/478 |
| 4,955,595 | 9/1990 | Kawano et al. | 271/9 |
| 5,000,435 | 3/1991 | Godlewski | 271/162 |
| 5,004,219 | 3/1991 | Godlewski | 271/117 |
| 5,104,112 | 4/1992 | Briggs et al. | 271/117 |
| 5,120,043 | 6/1992 | Marzullo | 271/117 |
| 5,164,906 | 11/1992 | Mahmoodi et al. | 271/9 |

FOREIGN PATENT DOCUMENTS

| | | | |
|---|---|---|---|
| 0087425 | 4/1988 | Japan | 271/145 |
| 3106725 | 5/1991 | Japan | 271/162 |
| 40179661 | 6/1992 | Japan | 271/162 |

*Primary Examiner*—H. Grant Skaggs

*Attorney, Agent, or Firm*—Charles R. Malandra, Jr.; Melvin J. Scolnick

[57] ABSTRACT

The present invention provides an improvement for a document feeder comprising a feed deck, a separator assembly for separating and feeding individual documents, the separator assembly including a separator wheel disposed above the feed deck, drive structure for driving the separator wheel, and structure for adjustably positioning the separator wheel assembly to a position relative to the feed deck commensurate with the material being fed. The improvement comprises structure for pivotally coupling the document feeder to vertical frame members. The coupling structure is located at one end of the document feeder near the separator assembly. There are a pair of leg members extending below the feed deck, each of the leg members resting on a horizontal frame member at opposite sides of the document feed path. The leg members are laterally spaced so as not to interfere with documents being conveyed by the underlying document transport.

3 Claims, 3 Drawing Sheets

PIVOTING FEEDER ASSEMBLY FOR JAM ACCESS

FIELD OF THE INVENTION

This invention relates to document feeders, and in particular to a document feeder with an separator wheel assembly in an inserter machine.

BACKGROUND OF THE INVENTION

In the inserter field, it is known to have a modular inserter system comprising various types of modules that can be combined to form inserter machines which meet the particular needs of each user. The types of modules that may be combined to form an inserter machine include, but are not limited to, envelope feeder, insert feeder, envelope feeder, folder, accumulator and insert station modules. Heretofore, document, insert and envelope feeders have been rigidly coupled to the frame of the inserter machine. Generally, the close proximity of the document and insert feeders has made it difficult to access the paper path underlying the second document feeder to clear document jams. This has been a common problem, especially for table top inserters where the amount of space within and between feeders is limited.

An example of a modular table top inserter system is described in U.S. Pat. No. 4,942,535, issued Jul. 17, 1990, to Robert J. Francisco and assigned to the assignee of the present invention. In U.S. Pat. No. 5,104,112, issued Apr. 14, 1992, to Francis J. Briggs, et al. and assigned to the assignee of the present invention, a feeder that is suitable for feeding documents, inserts or envelopes is disclosed having a reversibly positioned direct drive separator assembly motor. The document feeder is suitable for use as document, insert and envelope feeders in a modular table top inserting machine, such as the Pitney Bowes Spectrum™ inserting system. In each configuration of the inserter system, at least one of the feeder modules includes an underlying document transport.

In U.S. Pat. No. 5,164,906, issued Nov. 17, 1992, to Susan Mahmoodi, et al. and assigned to the assignee of the present invention, a submodule feeder arrangement is disclosed in which a first document feeder feeds a document to a document transport path which passes beneath a second document feeder which is immediately adjacent to the first document feeder. In this arrangement the feeders are in closer proximity than if two separate feeder modules were used.

Other document feeder assemblies are disclosed in U.S. Pat. No. 4,007,181, issued Mar. 7, 1978 to L. Asher, et al., U.S. Pat. No. 4,501,417, issued Feb. 26, 1985, to D. Foster, et al., U.S. Pat. No. 4,728,095, issued Mar. 1, 1988, to R. Irvine, et al., and U.S. Pat. No. 4,635,922, issued Jan. 13, 1987, to F. Roetter, et al., all being assigned to the assignee of the present invention.

All of the foregoing feeder assemblies share the same problem of limited accessibility to the document paper path underlying the feeder assembly. In U.S. Pat. No. 5,180,157, issued Jan. 19, 1993, to T. Helit, et al. and assigned to the assignee of the present invention, a self-contained transport apparatus with a drawer mount is disclosed for providing access to a document transport path underlying a document feeder. Although the drawer mount provides a suitable means for access to the document transport, it is a complex structure that is more suitable for console inserting machines that are much larger in size and have much larger document feeders than table top inserting machines.

It is an object of the present invention to provide simple access to the document path underlying a feeder assembly. It is a further object to improve access to the document path between feeder assemblies.

SUMMARY OF THE INVENTION

It has been found that a document feeder can be pivotally mounted to an inserter machine frame to provide easy access to an underlying transport for clearing paper jams.

The present invention provides an improvement for a document feeder comprising a feed deck, a separator assembly for separating and feeding individual documents, the separator assembly including a separator wheel disposed above the feed deck, means for driving the separator wheel, and means for adjustably positioning the separator wheel assembly to a position relative to the feed deck commensurate with the material being fed. The improvement comprises means for pivotally coupling the document feeder to vertical frame members. The coupling means is located at one end of the document feeder near the separator assembly. There are a pair of leg members extending below the feed deck, each of said leg members resting on a horizontal frame member at opposite sides of the document feed path. The leg members are laterally spaced so as not to interfere with documents being conveyed by the underlying document transport.

DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE PRESENT INVENTION

Figure 1:
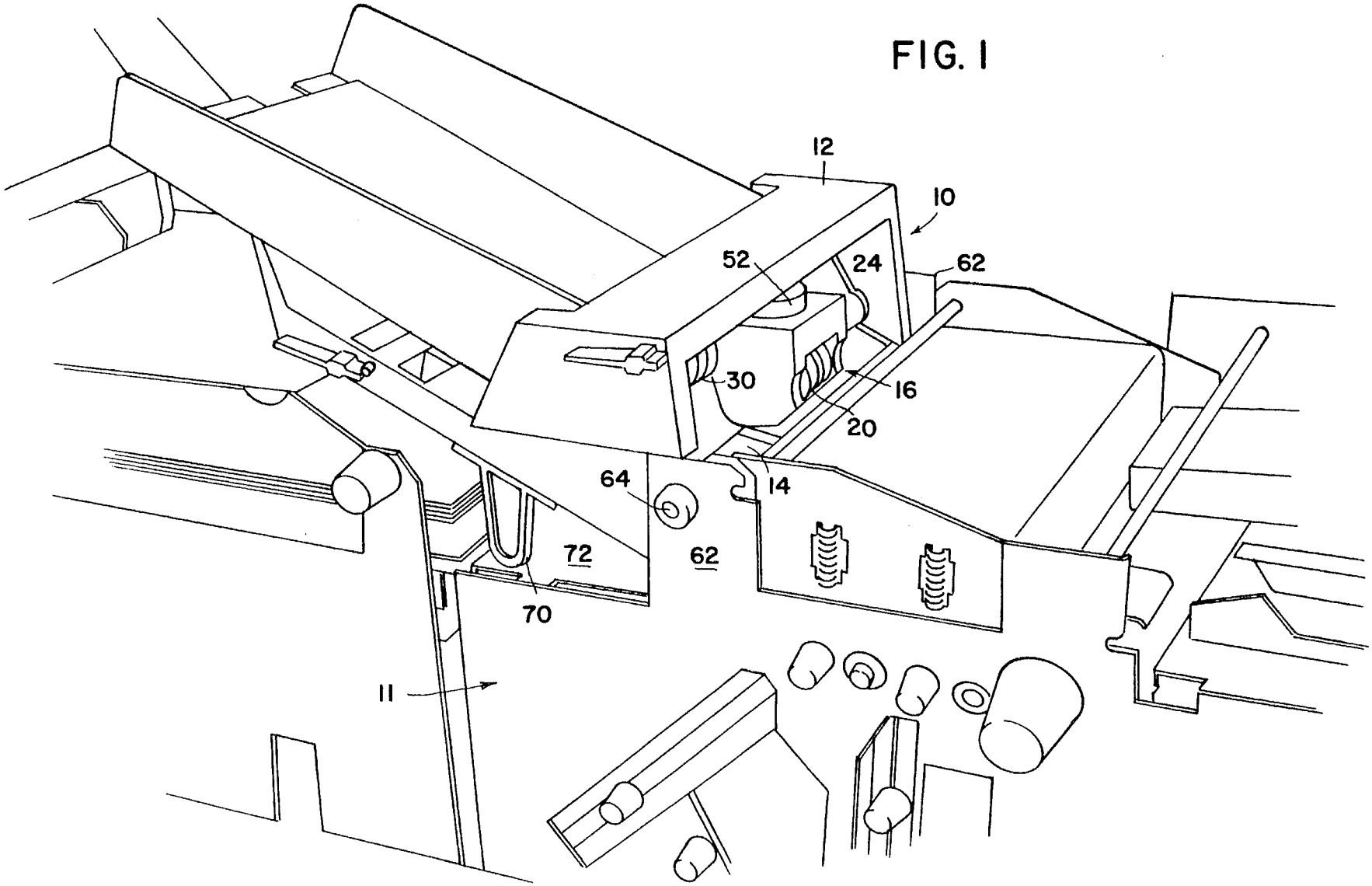
FIG. 1 is a perspective view of a pivoting feeder assembly in accordance with the present invention.
Figure 2:
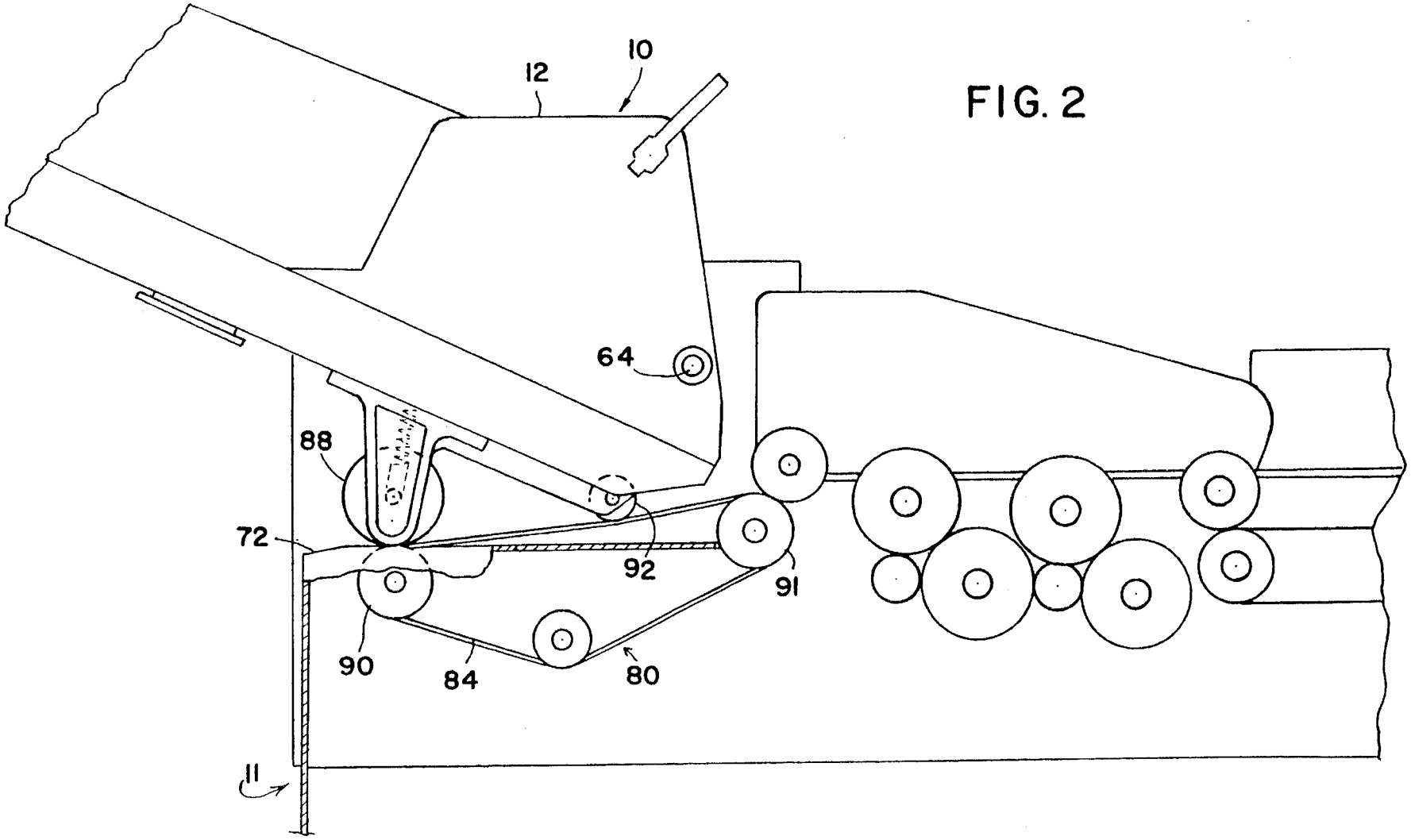
FIG. 2 is a side elevational view of the pivoting feeder assembly of FIG. 1.
Figure 3:
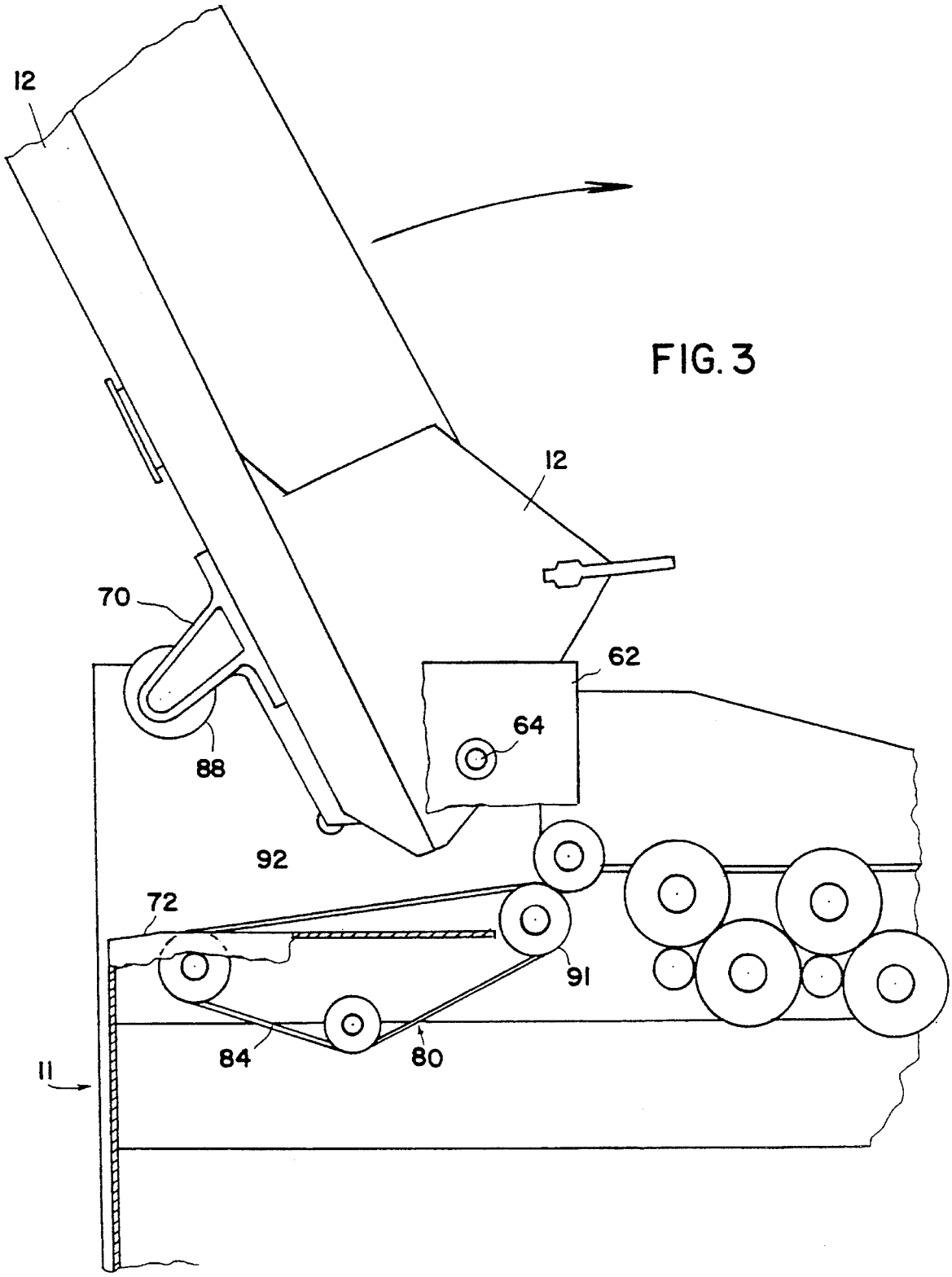
FIG. 3 is a side elevational view of the feeder assembly of FIG. 2 pivoted to a raised position for accessing a document transport path underlying the feeder assembly.

In describing the present invention, reference is made to the drawings, wherein there is seen in FIGS. 1–3 a document feeder 10 that is part of a feeder module, generally designated 11.

Document feeder 10 comprises a frame 12, including a feed deck 14 for holding a stack of sheets to be fed, and a separator wheel assembly 16, adjustably mounted to frame 12 above feed deck 14. A small dc motor 24 is mounted adjacent to wheel assembly 16 for directly driving separator wheels 20. Prefeed wheels 30 are coupled to the drive of separator wheel assembly 16 to cooperate with separator wheels 20 in restricting the feeding to single sheets. The direct drive motor 24 is positionable on either side of separator wheel assembly 16 for achieving offset feeding adjustments of separator wheel assembly 16. The separator wheel assembly 16 is spring biased for adjusting its position above feed deck 14 by means an indexing wheel 52 to a position commensurate with the characteristics of the material being fed. A more detailed description of the document feeder is provided in U.S. Pat. No. 5,104,112, previously noted, which is hereby incorporated by reference.

In accordance with the present invention, the entire feeder assembly 10 is pivotally mounted in a conventional manner to frame members 62 of feeder module 11. In the preferred embodiment of the present invention, a pin 64 is inserted through a hole in frame member 62 and a hole in frame 12 at opposite sides of feeder assembly 10 to pivotally secure frame 12 and feeder assembly 10 to the inserter module frame.

Referring now to FIGS. 1 and 2, feeder assembly 10 is shown in its normal operating position in feeder module 11. A pair of leg members 70 (only one of which is shown in the drawings) support feeder assembly 10 against deck plate 72 of feeder module 11. Leg members 70 extend from the lower side of frame 12 and are laterally spaced so as not to interfere with documents being transported under feeder assembly 10 by underlying transport 80. Transport 80 is a conventional dual flat belt and pulley transport 84 (only one belt and set of pulleys are shown in the drawings). Between leg members 70 are a pair of spring biased roller assemblies 88 (only one of which is shown in the drawings) which are laterally spaced to operate as pressure rollers against the dual flat belt transport. Since roller assemblies 88 are opposite pulleys 90 of transport 84, roller assemblies 88 are spring biased to accommodate various thicknesses of documents being transported thereby. There is a second pair of pressure rollers 92 that are located at the bottom of the front end of feeder assembly 10. Like roller assemblies 88, rollers 92 are laterally spaced to operate as pressure rollers against the dual flat belt transport. Rollers 92 are not spring biased because they contact the belts 84 between pulleys 90 and 91 where the belts can accommodate various thicknesses of the documents being transported.

Referring now to FIG. 3, feeder assembly 10 is shown in a raised position, pivoting about pin 64. In this raised position feeder frame 12 is pivoted out of the way for easy access to underlying transport 80. In this manner, paper jams can easily cleared and feeder assembly 10 can be lowered for immediate continuation of the inserter machine operation.

The present invention is particularly suited to a feeder assembly having an integral separator assembly drive such as feeder assembly 10. Such a feeder assembly is not limited in such pivoting motion because the drive is entirely within the feeder assembly that is being pivoted. However, it will be understood by those skilled in the art that such a pivoting arrangement may be used with larger document feeders having a pivot point that is coaxial with the drive means.

While the present invention has been disclosed and described with reference to a single embodiment thereof, it will be apparent, as noted above that variations and modifications may be made therein. It is also noted that the present invention is independent of the machine being controlled, and is not limited to the control of inserting machines. It is, thus, intended in the following claims to cover each variation and modification that falls within the true spirit and scope of the present invention.

What is claimed is:

1. In a document feeder in an inserting machine situated above underlying document transport, the feeder comprising a feed deck, a separator assembly for separating and feeding individual documents, the separator assembly including a separator wheel disposed above the feed deck, means for driving the separator wheel, and means for adjustably positioning the separator wheel assembly to a position relative to the feed deck commensurate with the material being fed, the improvement comprising:

means for pivotally coupling the document feeder to a frame, said coupling means being located at an end of the document feeder containing the separator assembly;

a pair of leg members extending below the feed deck, each of said leg members resting on opposite sides of the underlying document transport means, said leg members being laterally spaced so as not to interfere with documents being conveyed by the underlying document transport means; and at least one pair of pressure rollers located between said leg members, said pressure rollers applying a normal force to the underlying transport means.

2. The improvement of claim 1 wherein the means for pivotally coupling includes a pin extending through the feeder and frame members on each side of the feeder.

3. A method of improving access to a document transport under a document feeder, comprising the steps of:

providing a document feeder assembly having a direct drive separator assembly motor therein;

pivotally connecting one end of the document feeder assembly to a frame;

providing leg members to the underside of the other end of the document feeder assembly for supporting said other end in an operating position;

providing pressure rollers mounted to the underside of the document feeder assembly to apply a normal force to the document transport to transport documents under the document feeder assembly; and raising said other end of the document feeder assembly to access the document transport thereunder.

* * * * *